US010787343B2

(12) United States Patent
Zhao et al.

(10) Patent No.: US 10,787,343 B2
(45) Date of Patent: Sep. 29, 2020

(54) SELF-CLIMBING ROBOT FOR INSTALLING ELEVATOR GUIDE RAIL

(71) Applicants: Yanshan University, Qinhuangdao (CN); Shanghai Haishunxi Intelligent Technology Co., Ltd., Shanghai (CN)

(72) Inventors: Yanzhi Zhao, Qinhuangdao (CN); Longguang Han, Qinhuangdao (CN); Kaida Guo, Qinhuangdao (CN); Guoqing Li, Qinhuangdao (CN); Yu Shan, Qinhuangdao (CN)

(73) Assignees: Yanshan University, Qinhuangdao (CN); Shanghai Haishunxi Intelligent Technology Co., Ltd., Shanghai (CN)

( * ) Notice: Subject to any disclaimer, the term of this patent is extended or adjusted under 35 U.S.C. 154(b) by 0 days.

(21) Appl. No.: 16/558,480

(22) Filed: Sep. 3, 2019

(65) Prior Publication Data

US 2020/0165105 A1 May 28, 2020

(30) Foreign Application Priority Data

Nov. 23, 2018 (CN) ..... 2018 1 1405011

(51) Int. Cl.

| | |
|---|---|
| ***B66B 19/00*** | (2006.01) |
| ***E04G 3/28*** | (2006.01) |
| *B66B 7/02* | (2006.01) |

(52) U.S. Cl.

CPC ..... *B66B 19/002* (2013.01); *E04G 3/28* (2013.01); *B66B 7/023* (2013.01); *E04G 2003/286* (2013.01)

(58) Field of Classification Search

CPC ..... B66B 19/002; B66B 7/023; E04G 3/28; E04G 2003/286

See application file for complete search history.

(56) References Cited

U.S. PATENT DOCUMENTS 2,402,888 A * 6/1946 Hall ..... B66B 5/0087 33/645
3,851,736 A * 12/1974 Westlake ..... B66B 19/002 52/745.2

(Continued)

FOREIGN PATENT DOCUMENTS

| | | |
|---|---|---|
| CN | 1449356 A | 10/2003 |
| CN | 105384035 A | 3/2016 |
| JP | 2999706 B2 | 1/2000 |

*Primary Examiner* — Michael A Riegelman
(74) *Attorney, Agent, or Firm* — IP Attorneys Group, LLC

(57) ABSTRACT

The present invention discloses a self-climbing robot for installing an elevator guide rail, which comprises a climbing mobile platform, a working mobile platform, a rectangular parallelepiped frame and a PLC control unit. The frame is fixedly provided with a first platform, a second platform, a third platform and a fourth platform from bottom to top, the top end of a screw provided vertically is fixedly connected with the fourth platform, and the bottom end of the screw is fixedly connected with the first platform; the climbing mobile platform and the working mobile platform are provided with a nut engaged with the screw and a driving mechanism capable of driving the rotation of the nut, respectively, the driving mechanism comprises a driving motor and a pulley box, the working mobile platform is located above the climbing mobile platform, both the climbing mobile platform and the working mobile platform are slidingly connected with the frame, and the climbing mobile platform and the working mobile platform are only capable of sliding in the vertical direction. The self-climbing robot for installing the elevator guide rail according to the present invention can automatically complete the task of measuring a well and installing a guide rail, and can self-climb in the elevator well.

9 Claims, 9 Drawing Sheets

(56) References Cited

U.S. PATENT DOCUMENTS

| | | | | |
|---|---|---|---|---|
| 4,345,671 | A * | 8/1982 | Tosato | B66B 19/002 29/429 |
| 2011/0067252 | A1* | 3/2011 | Van Der Meijden | G01C 15/10 33/404 |
| 2015/0128403 | A1* | 5/2015 | Valkama | B66B 19/002 29/464 |
| 2015/0314993 | A1* | 11/2015 | Bolme | B66B 19/002 52/741.1 |
| 2016/0068369 | A1* | 3/2016 | Valkama | B66B 7/1246 33/645 |
| 2016/0311657 | A1* | 10/2016 | Kilpelainen | B66B 19/002 |
| 2016/0311658 | A1* | 10/2016 | Kilpelainen | B66B 19/002 |
| 2016/0311659 | A1* | 10/2016 | Mertala | B66B 19/002 |
| 2016/0325968 | A1* | 11/2016 | Baker | B66B 7/02 |
| 2017/0036890 | A1* | 2/2017 | Haag | B66B 7/026 |
| 2017/0313553 | A1* | 11/2017 | Puntener | B66B 19/002 |
| 2018/0208438 | A1* | 7/2018 | Cambruzzi | B66B 11/0005 |
| 2018/0273349 | A1* | 9/2018 | Weibel | B66B 19/00 |
| 2019/0106296 | A1* | 4/2019 | Barneman | B66B 19/002 |
| 2020/0055709 | A1* | 2/2020 | Cambruzzi | B66B 19/002 |
| 2020/0165105 | A1* | 5/2020 | Zhao | B66B 19/002 |

* cited by examiner

SELF-CLIMBING ROBOT FOR INSTALLING ELEVATOR GUIDE RAIL

This application claims priority to Chinese application number 201811405011.2, filed Nov. 23, 2018, with a title of Self-climbing robot for installing elevator guide rail. The above-mentioned patent application is incorporated herein by reference in its entirety.

TECHNICAL FIELD

The present invention relates to the field of installation equipment for an elevator guide rail, and more particularly to a self-climbing robot for installing an elevator guide rail.

BACKGROUND

In recent years, with the increase in the number of high-rise buildings, the demand for elevators has increased, resulting in an increase in the workload of elevator wells. The main job of elevator installation is to install the elevator guide rails. The installation effect of the elevator depends on the installation precision of the guide rails. At present, the elevator guide rails are generally installed manually, and the workers ensure the installation precision of the guide rails through repeated installation inspections. However, there are many shortcomings in the manual installation of the guide rails that: the high-precision installation of the elevator guide rails requires high experience for the operators; even if for the experienced operators, the installation precision of the guide rails needs to be ensured by repeated adjustment of the position of the installing parts. In addition, since the space of the well is narrow, the depth of the well is deep, and the work intensity of the workers is large, the workers are prone to fatigue for the long-term well operation, which leads to safety accidents. These are not in line with the requirements of current safe production, so the realization of well automation, especially the high-precision automated installation of elevator guide rails, has become an urgent problem to be solved.

SUMMARY

The object of the present invention is to provide a self-climbing robot for installing an elevator guide rail to solve the above problems in the prior art, and realize self-climbing of the robot in the elevator well so that the robot can automatically complete the task of measuring a well and installing a guide rail so as to reduce the work intensity of workers.

In order to achieve the above object, the present invention provides the following solution. The present invention provides a self-climbing robot for installing an elevator guide rail, comprising: a climbing mobile platform, a working mobile platform, a rectangular parallelepiped frame and a PLC control unit, wherein the frame is fixedly provided with a first platform, a second platform, a third platform and a fourth platform from bottom to top, the top end of a screw provided vertically is fixedly connected with the fourth platform, and the bottom end of the screw is fixedly connected with the first platform; the climbing mobile platform and the working mobile platform are provided with a nut engaged with the screw and a driving mechanism capable of driving the rotation of the nut, respectively, the driving mechanism comprises a driving motor and a pulley box, the working mobile platform is located above the climbing mobile platform, both the climbing mobile platform and the working mobile platform are slidingly connected with the frame, and the climbing mobile platform and the working mobile platform are only capable of sliding in the vertical direction;

the second platform and the climbing mobile platform are fixedly provided with four rail clamps corresponding to the guide rail, respectively;

the third platform and the fourth platform are horizontally provided with four sets of cross-shaped sliding platforms, respectively, the long strokes of the cross-shaped sliding platforms on the car side and the counterweight side are in parallel with the side walls of the car side and the counterweight side, respectively, the upper slider of the cross-shaped sliding platform is fixedly connected with a rail clamp, respectively, the bottom surface of the third platform is fixedly provided with four tightening devices a corresponding to the guide rail, the bottom surface of the fourth platform is fixedly provided with four linear sliding platforms c in the X-axis direction corresponds to the guide rail, each of the linear sliding platforms c is fixedly provided with two impact drills, and the distance between the two impact drills is equal to the center distance between expanded bolt holes of a guide rail bracket;

the upper plane of the working mobile platform is provided with four linear sliding platforms a corresponding to the guide rail, each of the linear sliding platforms a is fixedly connected with a bracket push rod, the bracket push rod is provided with a set of tightening devices b, the bracket push rod at the car side is symmetrically provided with two welding guns, the bracket push rod at the counterweight side is provided with a welding gun; the upper plane of the working mobile platform is provided with four linear sliding platforms b corresponding to the guide rail, the upper slider of each of the linear sliding platforms b is fixedly connected with a rail clamp;

the driving motor, the cross-shaped sliding platform, the tightening device a, the tightening device b, the linear sliding platform a, the linear sliding platform b, the linear sliding platform c, and all of the above rail clamps are electrically connected with the PLC control unit, respectively.

Preferably, the climbing mobile platform is located between the first platform and the second platform, and the working mobile platform is located between the third platform and the fourth platform.

Preferably, the frame between the first platform and the second platform is provided with four vertical first guide rails, the climbing mobile platform is fixedly provided with a slider slidably engaged with the first guide rails; the frame between the third platform and the fourth platform is provided with four vertical second guide rails, and the climbing mobile platform is fixedly provided with a slider slidably engaged with the second guide rails.

Preferably, a base plate is provided between the first guide rail and the frame and between the second guide rail and the frame, respectively.

Preferably, the self-climbing robot for installing an elevator guide rail further comprises: a trolley car slidably engaged with the installed guide rail, wherein the bottom of the frame is provided with an electric winch capable of controlling the trolley car to lift.

Preferably, each of the tightening devices a and each of the tightening devices b comprise two electric wrenches, and the center distance between the two electric wrenches is equal to the distance between the center holes of the ends of the guide rail.

Preferably, the linear sliding platform a at the car side is provided along the Y axis, the linear sliding platform a at the counterweight side is provided along the X axis; the linear sliding platform b at the car side is provided along the Y axis, and the linear sliding platform b at the counterweight side is provided along the X axis.

Preferably, the bracket push rod is welded by a steel plate and an angle iron.

Preferably, the driving motor is a servo motor.

The self-climbing robot for installing an elevator guide rail according to the present invention achieves the following technical effects with respect to the prior art.

The self-climbing robot for installing the elevator guide rail according to the present invention realizes the self-climbing of the robot in the elevator well, and the robot can automatically complete the task of measuring a well and installing a guide rail so as to reduce the work intensity of workers. The self-climbing robot for installing the elevator guide rail according to the present invention can climb along the installed guide rail when installing the elevator guide rail, and automatically install the next guide rail after climbing to the top of the installed guide rail, and so on, so as to complete the entire installation of the elevator guide rail. The present invention eliminates the process of scaffolding in the traditional method for installing the elevator guide rail, and at the same time, and no worker participation is required in the well during the construction operation, avoiding dangerous accidents, and ensuring the safety of the workers.

BRIEF DESCRIPTION OF THE DRAWINGS

In order to more clearly illustrate the embodiments of the present invention or the technical solutions in the prior art, the drawings to be used in the embodiments will be briefly described below. Obviously, the drawings in the following description are merely some embodiments of the present invention. Other drawings may be obtained from these drawings for those skilled in the art without any creative labor.

In these drawings, 1-*a* first platform, 2-*a* climbing mobile platform, 3-*a* third platform, 4-*a* working mobile platform, 5-*a* fourth platform, 6-*a* screw, 7-*a* second platform, 8-*a* frame, 9-an installed guide rail, 10-*a* well, 101-*a* square steel plate, 102-*a* ball screw base, 103-*a* short linear guide rail, 104-*a* short base plate, 105-*a* long linear guide rail, 106-*a* long base plate, 107-*a* short square tube, 201-*a* rail clamp a, 202-*a* linear guide rail slider a, 203-*a* channel steel a, 204-*a* pulley box a, 205-*a* servo motor a, 206-*a* right-angled connecting plate a, 301-*a* tightening device a, 302-*a* rail clamp c, 303-*a* cross-shaped sliding platform a, 401-*a* rail clamp d, 402-*a* linear sliding platform b, 403-*a* linear guide rail slider b, 404-*a* welding gun, 405-*a* channel steel b, 406-*a* beam, 407-*a* pulley box b, 408-*a* tightening device b, 409-*a* bracket push rod, 410-*a* servo motor b, 411-*a* linear sliding platform a, 412-*a* right-angled connecting plate b, 501-*a* cross-shaped sliding platform b, 502-*a* rail clamp e, 503-*a* linear sliding platform c, 504-*a* impact drill, 701-*a* rail clamp b.

DESCRIPTION OF THE EMBODIMENTS

The technical solutions in the embodiments of the present invention are clearly and completely described hereinafter with reference to the accompanying drawings in the embodiments of the present invention. It is obvious that the described embodiments are merely a part of the embodiments of the present invention, rather than all embodiments. All other embodiments obtained by those skilled in the art based on the embodiments of the present invention without creative efforts are within the scope of the present invention.

The object of the present invention is to provide a self-climbing robot for installing an elevator guide rail to solve the problems existing in the prior art and realize the self-climbing of the robot in the elevator well, so that the robot can automatically complete the task of measuring a well and installing a guide rail so as to reduce the work intensity of workers.

The present invention will be further described in detail with reference to the accompanying drawings and specific embodiments so that the above objects, features and advantages of the present invention can be more clearly understood.

Figure 1:
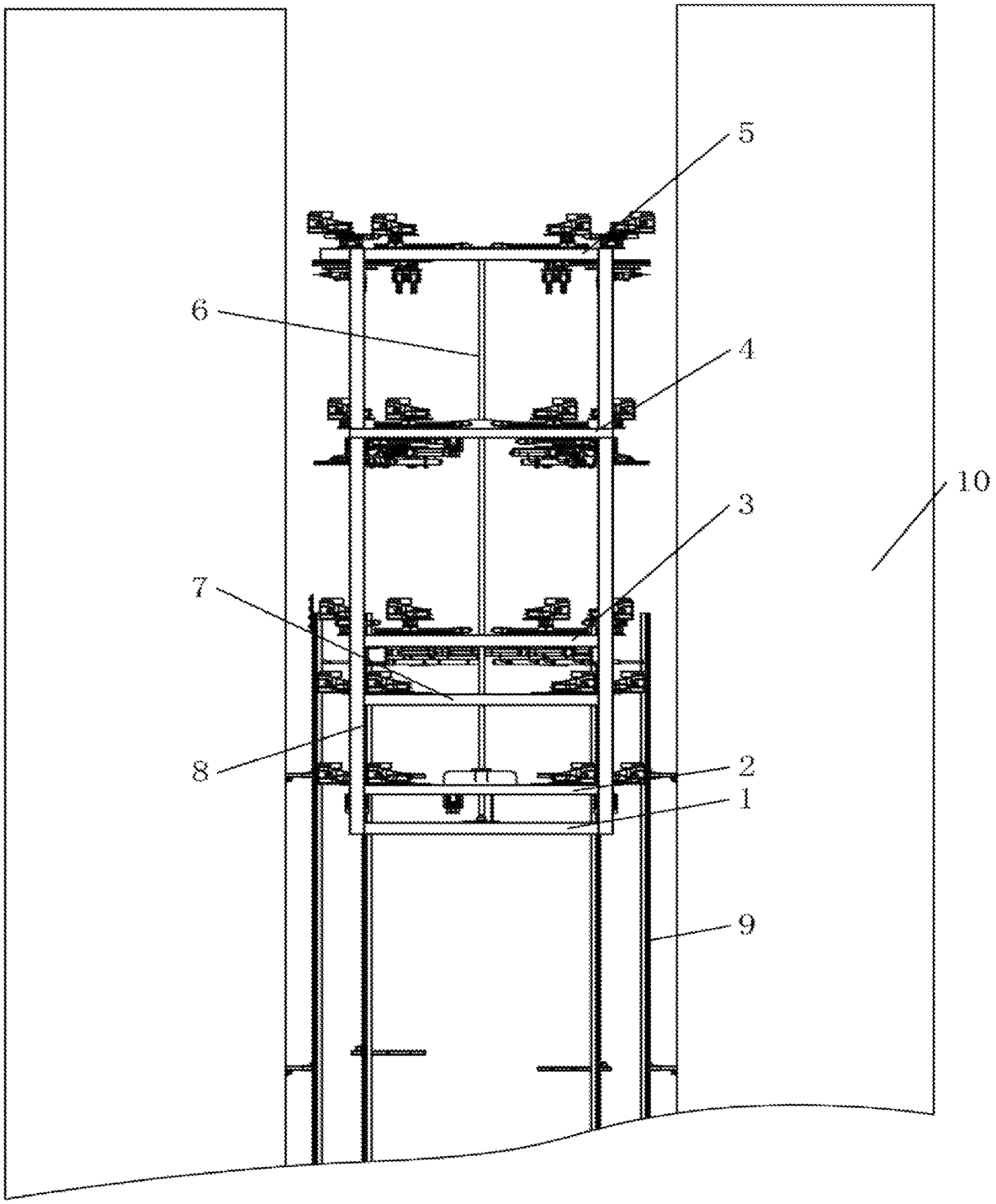
FIG. 1 is a schematic view illustrating the operation of a self-climbing robot for installing an elevator guide rail in an elevator well according to the present invention.
Figure 2:
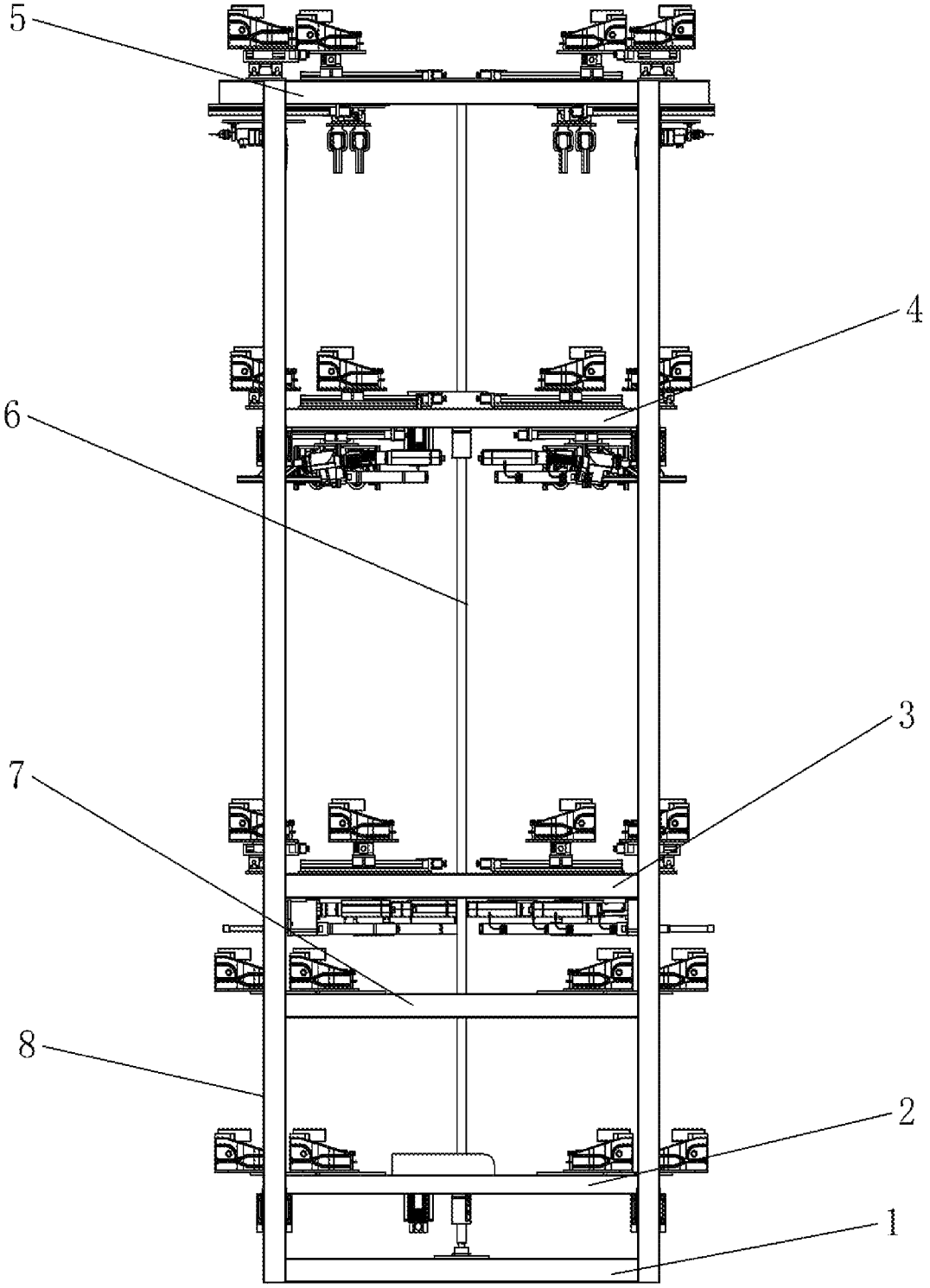
FIG. 2 is a front view illustrating a self-climbing robot for installing an elevator guide rail according to the present invention.
Figure 3:
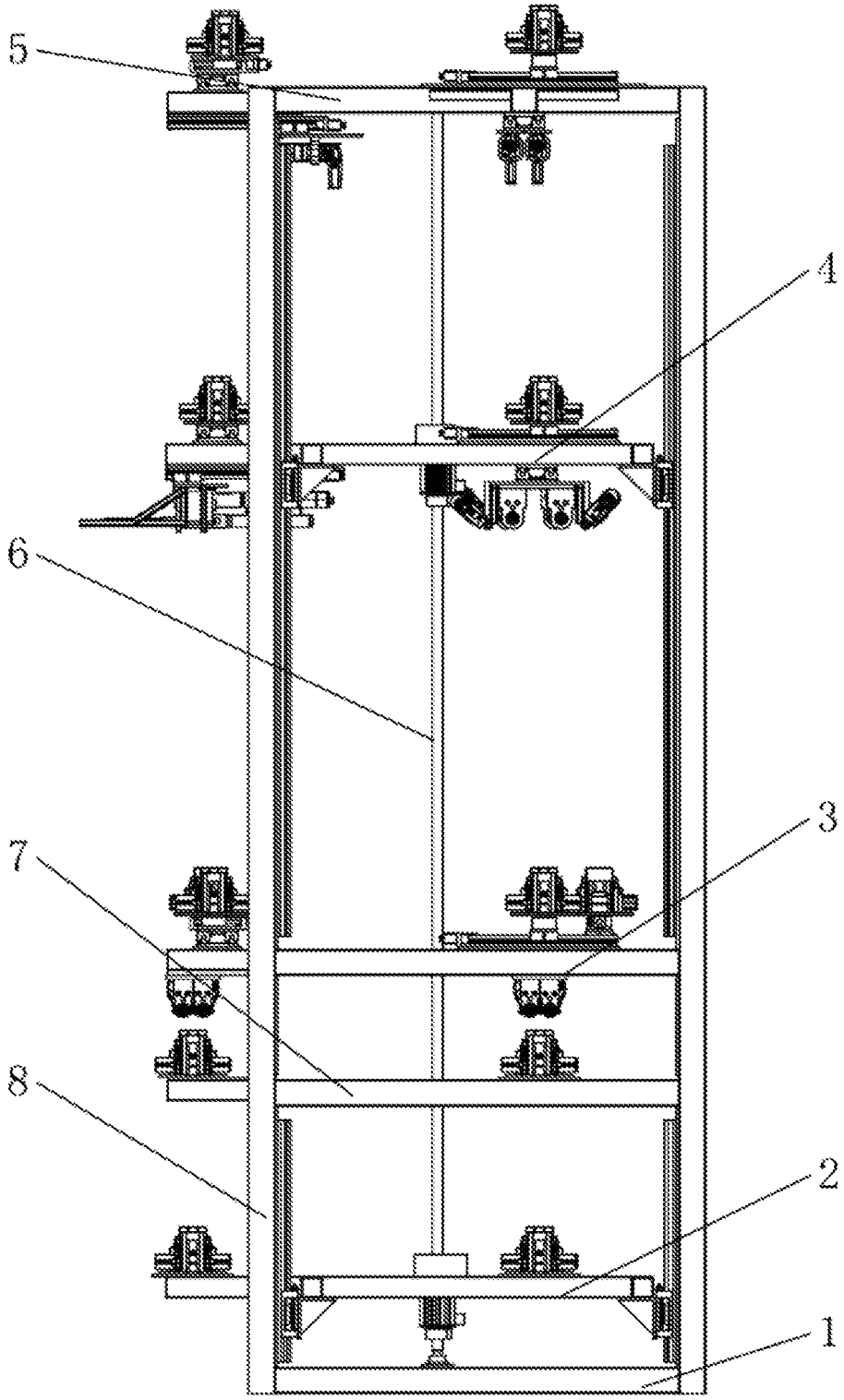
FIG. 3 is a left view illustrating a self-climbing robot for installing an elevator guide rail according to the present invention.
Figure 4:
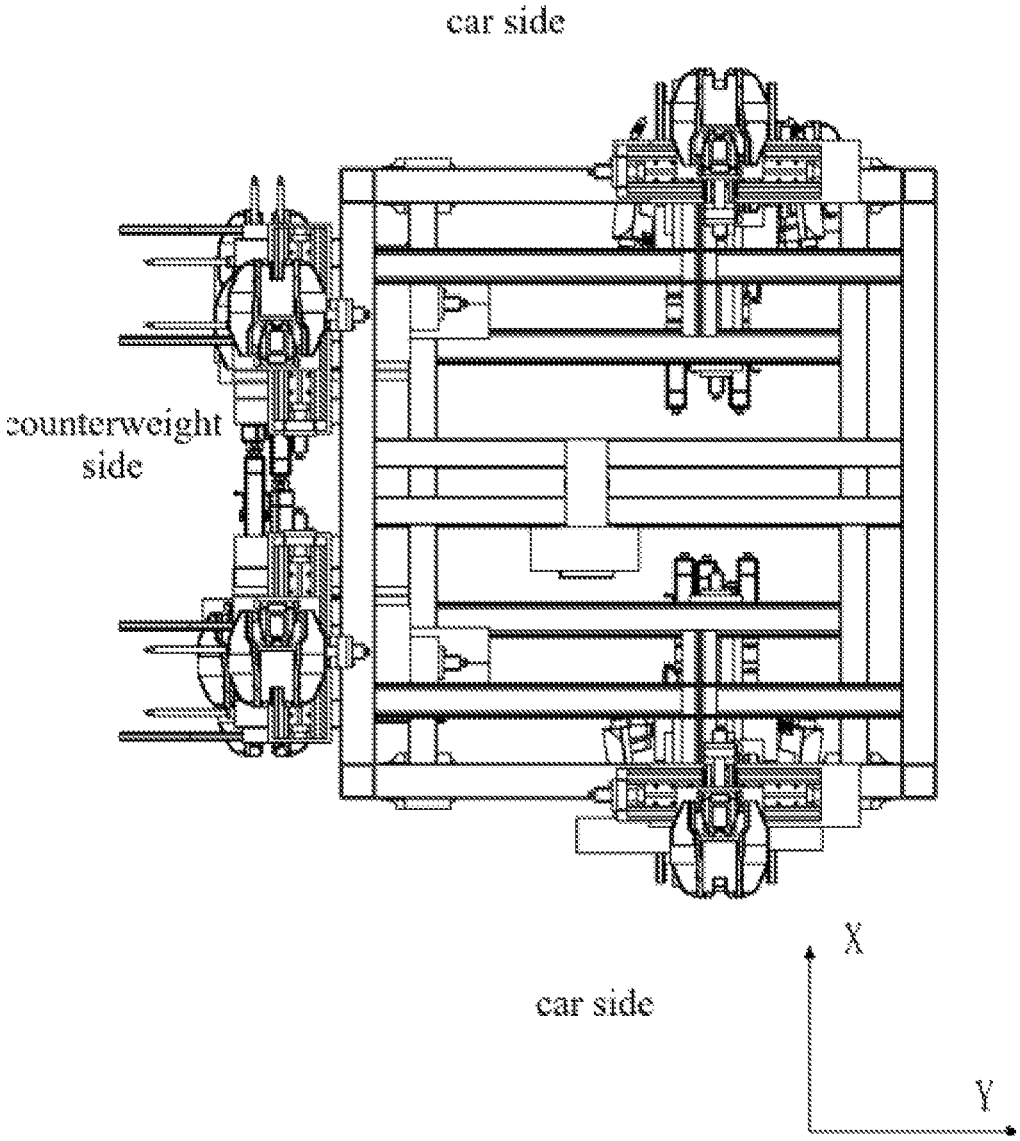
FIG. 4 is a top view illustrating a self-climbing robot for installing an elevator guide rail according to the present invention.
Figure 5:
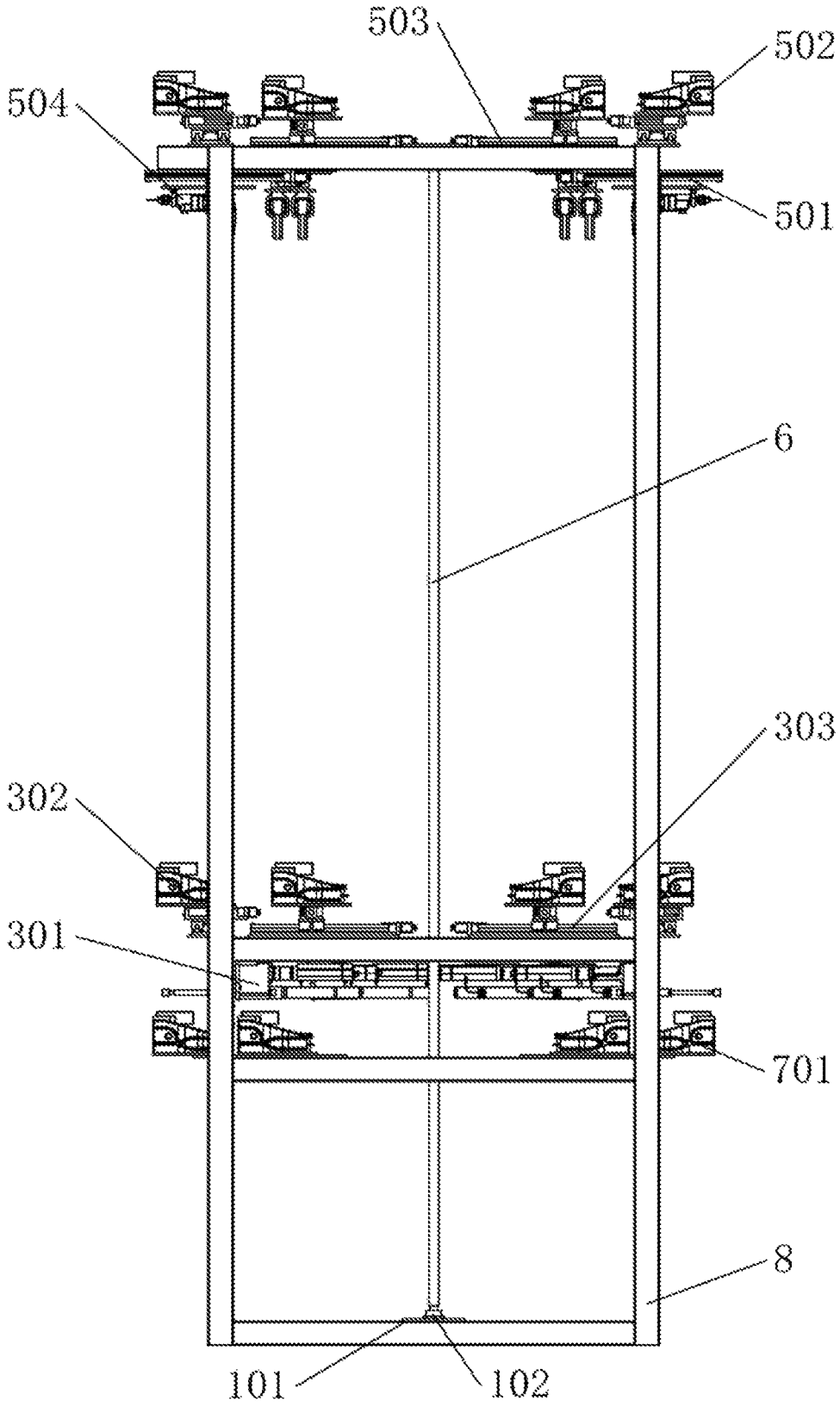
FIG. 5 is a front view illustrating a frame of a self-climbing robot for installing an elevator guide rail according to the present invention.
Figure 6:
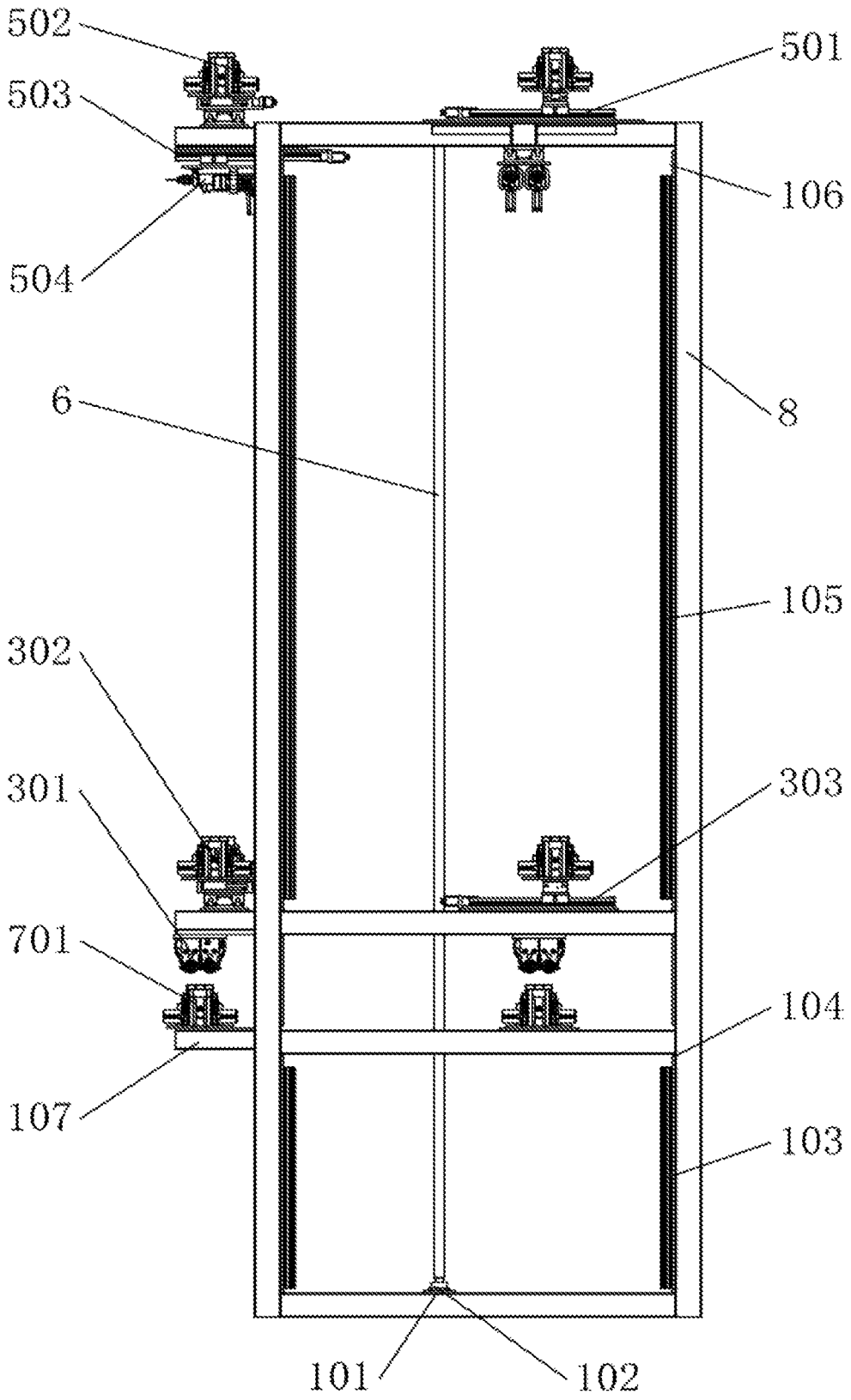
FIG. 6 is a left view illustrating a frame of a self-climbing robot for installing an elevator guide rail according to the present invention.
Figure 7:
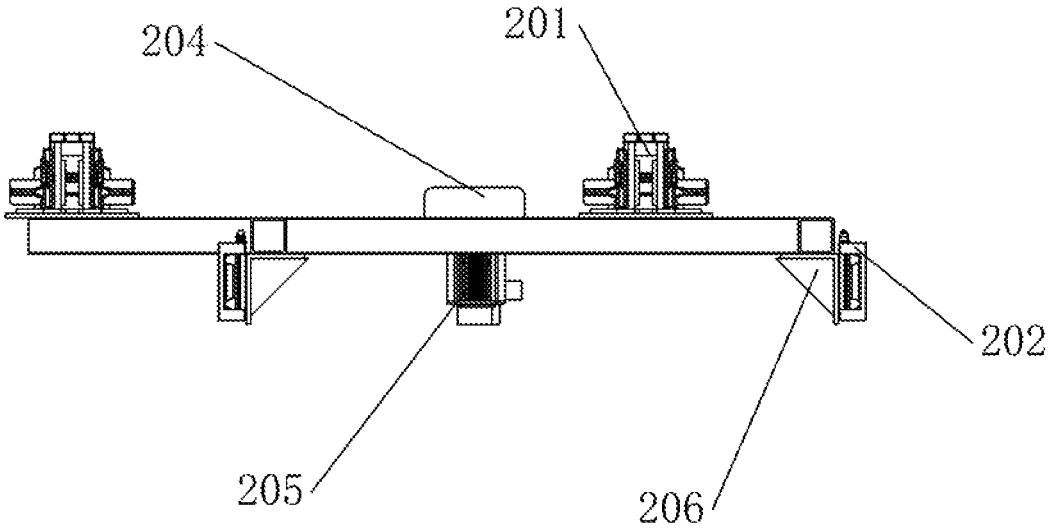
FIG. 7 is a left view illustrating a climbing mobile platform of a self-climbing robot for installing an elevator guide rail according to the present invention.
Figure 8:
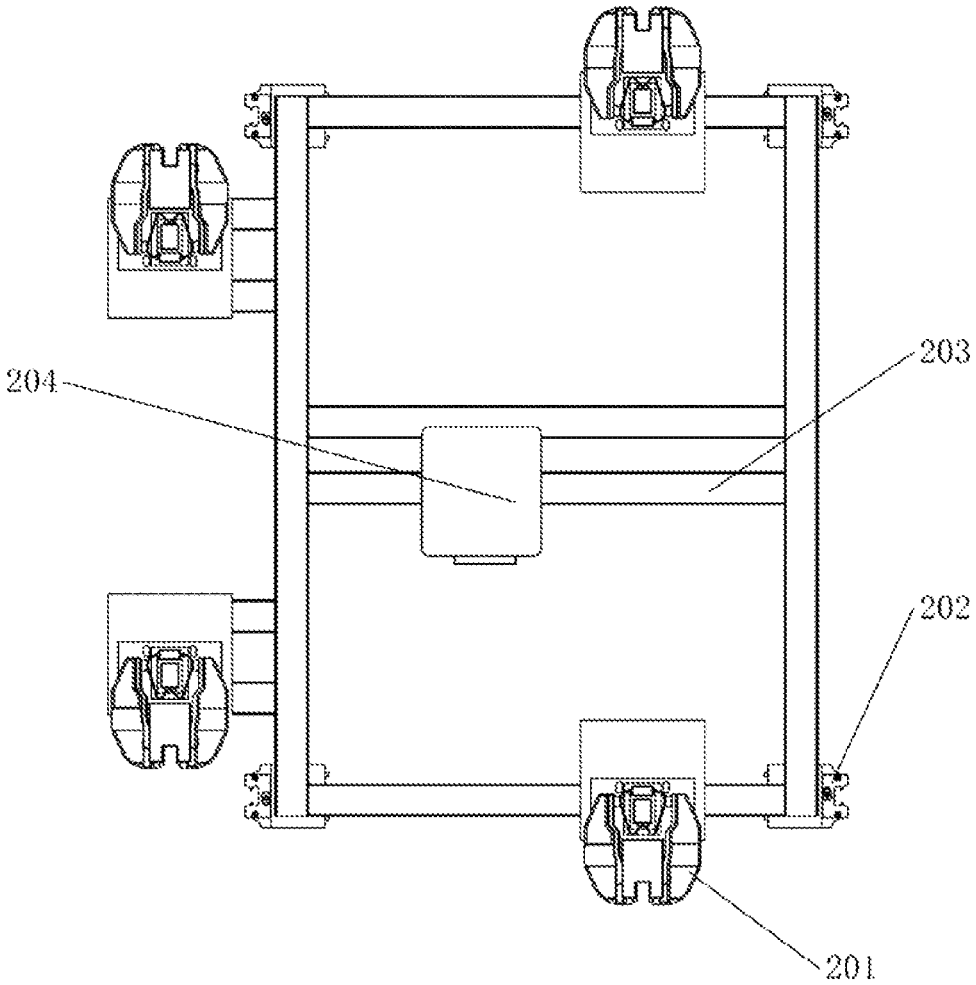
FIG. 8 is a top view illustrating a climbing mobile platform of a self-climbing robot for installing an elevator guide rail according to the present invention.
Figure 9:
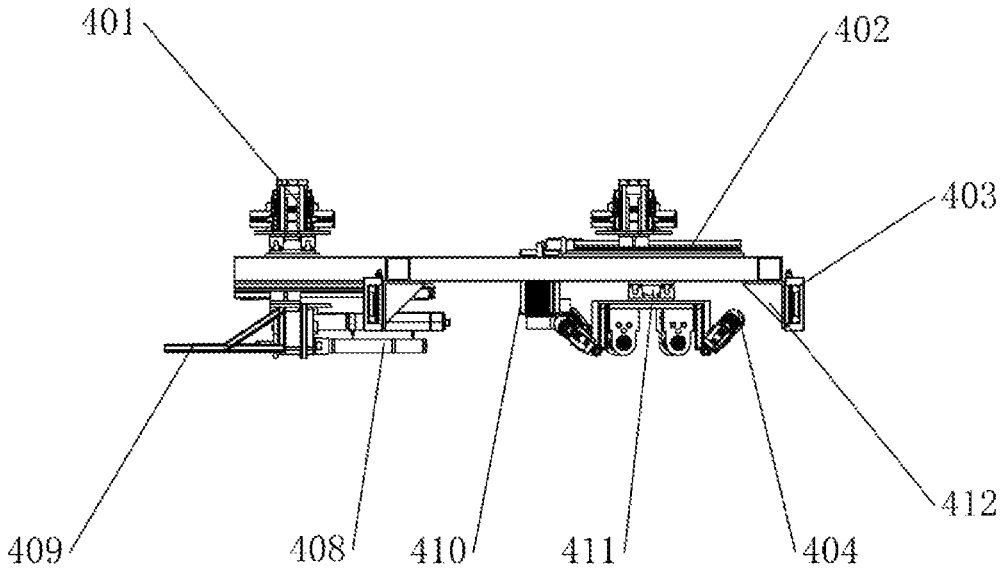
FIG. 9 is a left view illustrating a working mobile platform of a self-climbing robot for installing an elevator guide rail according to the present invention.
Figure 10:
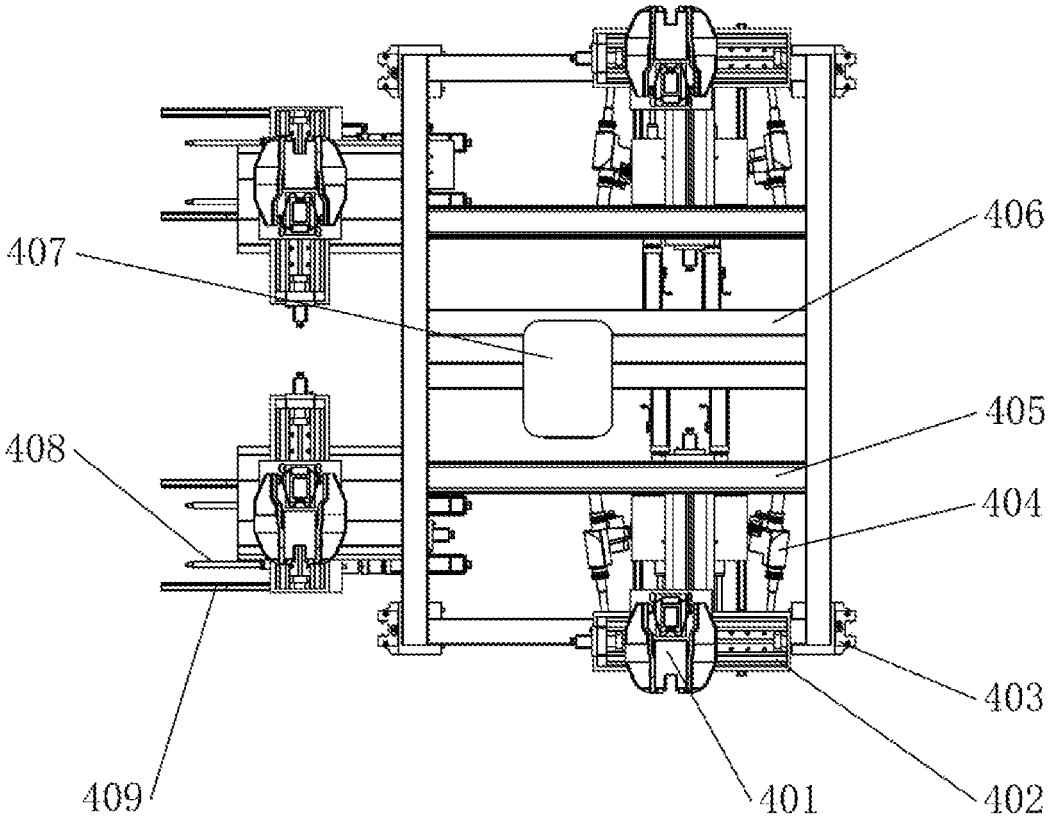
FIG. 10 is a top view illustrating a working mobile platform of a self-climbing robot for installing an elevator guide rail according to the present invention.

As shown in FIGS. 1-10, the self-climbing robot for installing an elevator guide rail according to the present embodiment comprises a frame 8, a climbing mobile platform 2, and a working mobile platform 4.

The frame 8 is a rectangular parallelepiped as a whole, and the frame 8 has four platforms from bottom to top, which are a first platform 1, a second platform 7, a third platform 3 and a fourth platform 5. Each of the platforms is welded by square tubes. Four short square tubes 107 are welded to the square tubes at counterweight side of the four platforms of the frame 8, wherein two short square tubes form a group, and each group of short square tubes 107 is adjacent to the counterweight guide rail at both sides. The top end of a screw 6 provided vertically is fixedly connected with the fourth platform 5, and the bottom end of the screw 6 is fixedly connected with the first platform 1; the climbing mobile platform 2 and the working mobile platform 4 are provided with a nut engaged with the screw 6 and a driving mechanism capable of driving the rotation of the nut, respectively, the driving mechanism comprises a driving motor and a pulley box, the working mobile platform 4 is located above the climbing mobile platform 2, both the climbing mobile platform 2 and the working mobile platform 4 are slidingly connected with the frame 8, and the climbing mobile platform 2 and the working mobile platform 4 are only capable of sliding in the vertical direction.

Four short base plates 104 are welded to the four long square tubes of the frame 8 between the first platform 1 and the second platform 7, a short linear guide rail 103 is fixedly connected with the short base plates 104 on the square tubes by bolts, four long base plates 106 are welded to the four long square tubes between the third platform 3 and the fourth platform 5, and the long linear guide rail 105 is fixedly connected with the long base plates 106 on the square tubes by bolts. The first platform 1 is fixedly connected with two channel steels in the middle, a square steel plate 101 is welded to the channel steel, and the ball screw base 102 is fixed on the square steel plate 101 by bolts.

The square tube on the second platform 7 opposite to the car side and the counterweight side is fixedly connected with the rail clamp b701 by bolts, and the rail clamp b701 is coincident with the corresponding guide rail.

Four sets of cross-shaped sliding platforms a303 are provided on the square tube corresponding to the guide rail on the upper plane of the third platform 3, the Y direction of the cross-shaped sliding platform at the car side is a long stroke, the X direction at the counterweight side is a long stroke, and the upper sliding block of the cross-shaped sliding platform a303 is connected with the rail clamp c302 by bolts. Four sets of tightening devices a301 are provided on the lower plane of the third platform 3. The position of the tightening device a301 is coincident with the position of the corresponding guide rail. Each set of tightening devices is formed by two sets of electric wrenches, and the center distance between each two electric wrenches is equal to the center distance between horizontal holes of the ends of the guide rail.

Four sets of cross-shaped sliding platforms b501 are provided on the square tube corresponding to the guide rail on the upper plane of the fourth platform 5, the Y direction of the cross-shaped sliding platform b501 at the car side is a long stroke, the X direction of the cross-shaped sliding platform b501 at the counterweight side is a long stroke, and the upper sliding block of the cross-shaped sliding platform b501 is connected with the rail clamp e502 by bolts. Four sets of linear sliding platforms c503 are provided on the square pipe corresponding to the guide rail on the lower plane of the fourth platform 5. The linear sliding platform c503 is provided along the X-axis direction. The linear sliding platform c503 is fixedly connected with the bracket of the impact drill 504 by bolts. The bracket of the impact drill 504 is provided with two impact drills 504, and the distance between the two impact drills 504 is equal to the center distance between expanded bolt holes of a guide rail bracket. The fourth platform 5 is fixedly connected with two channel steels in the middle. A square steel plate is welded in the middle of the channel steel, and the square steel plate is connected with a supporting base of the ball screw 6 by bolts.

The climbing mobile platform 2 comprises a square tube, four right-angled connecting plates a206, a linear guide rail slider a202, a rail clamp a201, a servo motor a205 and a pulley box a204. The climbing mobile platform 2 is welded by square tubes. Four short square tubes 107 are welded to the square tubes at counterweight side, wherein two short square tubes form a group, and each group of short square tubes 107 is adjacent to the counterweight side. A right-angled surface of the right-angled connecting plate a206 is connected with the climbing mobile platform 2, and the other right-angled surface is connected with the linear guide rail slider a202. Two channel steels a203 are provided in the middle of the climbing mobile platform 2, a nut is connected with the channel steel of the climbing mobile platform 2 by bolts, the servo motor a205 drives the nut to rotate through the pulley box a204, the servo motor a205 is fixedly connected with the climbing mobile platform 2, and a rail clamp a201 is provided on the square tube on the climbing mobile platform 2 opposite to the car guide rail and the counterweight guide rail.

The working mobile platform 4 comprises a square tube, a rail clamp d401, a right-angled connecting plate b412, a linear guide rail slider b403, a bracket push rod 409, a beam 406, a servo motor b410, a linear sliding platform a411, an electric wrench b, and a welding gun 404. The working mobile platform 4 is welded by square tubes. Four short square tubes 107 are welded to the square tubes at counterweight side, wherein two short square tubes 107 form a group, and each group of short square tubes 107 is adjacent to the counterweight side. A right-angled surface of the right-angled connecting plate b412 is connected with the climbing mobile platform 2, and the other right-angled surface is connected with the linear guide rail slider b403. The upper plane of the working mobile platform 4 is provided with four linear sliding platforms b402. The position of the linear sliding platform b402 is coincident with the position of the corresponding guide rail. The sliding platform at the car side is provided along the Y axis, the sliding platform at the counterweight side is provided along the X axis, and the upper slider of the linear sliding platform b402 is connected with the rail clamp d401 by bolts.

Four linear sliding platforms a411 are provided at the position corresponding to the guide rail on the lower plane of the working mobile platform 4, and the position thereof is consistent with the position of the corresponding guide rail. The linear sliding platform a411 at the car side is provided along the Y axis, and the linear sliding platform a411 at the counterweight side is provided along the X axis. The linear sliding platform a411 is fixedly connected with the bracket push rod 409 by bolts. The bracket push rod 409 is welded by the steel plate and the angle iron. The push rod 409 is provided with a set of tightening devices b408, and each set of tightening device b408 is formed by two electric wrenches. The end of the electric wrench is provided with a sleeve. The center distance between the two electric wrenches is equal to the center distance between the expanded bolt holes of the bracket. The bracket push rod 409 at the car side is symmetrically provided with two welding guns 404. The bracket push rod 409 at the counterweight side is provided with a welding gun 404. The working mobile platform 4 is welded with two channel steels b405 in the middle. The nut is connected with the channel steel b405 of the working mobile platform 4 by bolts, the servo motor b410 drives the nut to rotate through the pulley box b407, and the servo motor b410 is fixedly connected with the working mobile platform 4.

The robot self-climbing function is realized in the process that four rail clamps b701 fixed on the second platform 7 loosen the installed guide rail 9, the four rail clamps a201 fixedly connected on the climbing mobile platform 2 clamp the installed guide rail 9, the nut is driven by the servo motor a205, and the nut is moved relatively to the screw 6, so that the frame 8 is moved upward as a whole; after moving to a certain distance, the four rail clamps b701 fixedly connected on the second platform 7 clamp the installed guide rail 9, the four rail clamps a201 fixedly connected on the climbing mobile platform 2 loosen the installed guide rail 9, the servo motor a205 drives the nut so that the climbing mobile platform 2 moves downward by a set distance, and the above process is repeated to realize the overall self-climbing of the robot.

It is to be noted that the self-climbing robot for installing the elevator guide rail of the embodiment further comprises a PLC control unit for controlling turning on and off each device, the PLC control unit is programmable, and the automation of the installation work of the robot can be realized by the PLC control unit.

In this embodiment, the self-climbing robot for installing the elevator guide rail climbs up along the installed guide rail 9. When the robot climbs to the lower bracket position, the impact drill 504 of the fourth platform 5 drills the lower bracket hole. The robot continues to climb upwards. When the robot climbs to the upper bracket position, the impact drill 504 drills the upper bracket hole and transmits the upper and lower drilling data to the ground equipment. The robot climbs to the top of the installed guide rail 9 and locks the rail clamp to ensure the overall stiffness of the overall robot system. Workers install the bracket to the bracket to be installed according to the drilling data. The guide rail of the installed bracket is lifted by a trolley car. The four rail clamps d401 on the working mobile platform 4 clamp the guide rail and are driven by the linear sliding platform b402. The sliding platform of each rail clamp is simultaneously translated, so that the guide rail to be installed is completely above the installed guide rail 9. The servo motor b410 drives the nut to lower the working mobile platform 4 so that the bottom end of the guide rail to be installed is completely fit with the top end of installed guide rail. Thereafter, the guide rail joint is tightened by the tightening device b408. The working mobile platform 4 is moved to the lower bracket, and the bracket at one end of the bolt to be expanded is pushed onto the hole of the wall body, and then the expanded bolt nut is tightened by the tightening device b408. After the nut is tightened, the welding gun 404 fixed on the bracket push rod 409 is spot-welded at the opening of the guide rail bracket. The working mobile platform 4 is raised to install the upper bracket. This completes the installation of all the guide rail brackets in a similar fashion.

The robot can climb along the installed guide rail when installing the elevator guide rail. After the robot climbs to the top of the installed guide rail 9, the next guide rail can be automatically installed, and so on, so as to complete the entire installation of the elevator guide rail. The self-climbing robot for installing the elevator guide rail of the present embodiment eliminates the process of scaffolding in the traditional method for installing the elevator guide rail, and at the same time, and no worker participation is required in the well during the construction operation, thereby ensuring the safety of workers and reducing the occurrence of safety accidents.

In the description of the present invention, it is to be noted that the terms "top", "bottom", "X direction", "Y direction", "X axis", "Y axis", "vertical", "horizontal", etc. indicate the orientation or positional relationship based on the orientation or positional relationship shown in the drawings, and are merely for the convenience of the description of the present invention and the simplified description, rather than indicating or implying that the indicated device or component must have a specific orientation or must be constructed and operated in a specific orientation. Therefore, it is not to be construed as limiting the present invention.

The principles and embodiments of the present invention have been described in detail using specific examples in the present disclosure. The description of the above embodiments is only for the purpose of understanding the method of the present invention and the core idea thereof; at the same time, the specific embodiments and applications will vary based on the idea of the present invention to those skilled in the art. In summary, the content of the specification should not be construed as limiting the present invention.

What is claimed is:

1. A self-climbing robot for installing an elevator guide rail, comprising: a climbing mobile platform, a working mobile platform, a rectangular parallelepiped frame and a PLC control unit, wherein the frame is fixedly provided with a first platform, a second platform, a third platform and a fourth platform from bottom to top, the top end of a screw provided vertically is fixedly connected with the fourth platform, and the bottom end of the screw is fixedly connected with the first platform; the climbing mobile platform and the working mobile platform are provided with a nut engaged with the screw and a driving mechanism capable of driving the rotation of the nut, respectively, the driving mechanism comprises a driving motor and a pulley box, the working mobile platform is located above the climbing mobile platform, both the climbing mobile platform and the working mobile platform are slidingly connected with the frame, and the climbing mobile platform and the working mobile platform are only capable of sliding in the vertical direction;

the second platform and the climbing mobile platform are fixedly provided with four rail clamps corresponding to the guide rail, respectively;

the third platform and the fourth platform are horizontally provided with four sets of cross-shaped sliding platforms, respectively, the long strokes of the cross-shaped sliding platforms on the car side and the counterweight side are in parallel with the side walls of the car side and the counterweight side, respectively, the upper slider of the cross-shaped sliding platform is fixedly connected with a rail clamp, respectively, the bottom surface of the third platform is fixedly provided with four tightening devices a corresponding to the guide rail, the bottom surface of the fourth platform is fixedly provided with four linear sliding platforms c in the X-axis direction corresponds to the guide rail, each of the linear sliding platforms c is fixedly provided with two impact drills, and the distance between the two impact drills is equal to the center distance between expanded bolt holes of a guide rail bracket;

the upper plane of the working mobile platform is provided with four linear sliding platforms a corresponding to the guide rail, each of the linear sliding platforms a is fixedly connected with a bracket push rod, the bracket push rod is provided with a set of tightening devices b, the bracket push rod at the car side is symmetrically provided with two welding guns, the bracket push rod at the counterweight side is provided with a welding gun; the upper plane of the working mobile platform is provided with four linear sliding platforms b corresponding to the guide rail, the upper slider of each of the linear sliding platforms b is fixedly connected with a rail clamp;

the driving motor, the cross-shaped sliding platform, the tightening device a, the tightening device b, the linear sliding platform a, the linear sliding platform b, the linear sliding platform c, and all of the above rail clamps are electrically connected with the PLC control unit, respectively.

2. The self-climbing robot for installing an elevator guide rail according to claim 1, wherein the climbing mobile platform is located between the first platform and the second platform, and the working mobile platform is located between the third platform and the fourth platform.

3. The self-climbing robot for installing an elevator guide rail according to claim 2, wherein the frame between the first platform and the second platform is provided with four vertical first guide rails, the climbing mobile platform is fixedly provided with a slider slidably engaged with the first guide rails; the frame between the third platform and the fourth platform is provided with four vertical second guide rails, and the climbing mobile platform is fixedly provided with a slider slidably engaged with the second guide rails.

4. The self-climbing robot for installing an elevator guide rail according to claim 3, wherein a base plate is provided between the first guide rail and the frame and between the second guide rail and the frame, respectively.

5. The self-climbing robot for installing an elevator guide rail according to claim 1, further comprising: a trolley car slidably engaged with the installed guide rail, wherein the bottom of the frame is provided with an electric winch capable of controlling the trolley car to lift.

6. The self-climbing robot for installing an elevator guide rail according to claim 1, wherein each of the tightening devices a and each of the tightening devices b comprise two electric wrenches, and the center distance between the two electric wrenches is equal to the distance between the center holes of the ends of the guide rail.

7. The self-climbing robot for installing an elevator guide rail according to claim 1, wherein the linear sliding platform a at the car side is provided along the Y axis, the linear sliding platform a at the counterweight side is provided along the X axis; the linear sliding platform b at the car side is provided along the Y axis, and the linear sliding platform b at the counterweight side is provided along the X axis.

8. The self-climbing robot for installing an elevator guide rail according to claim 1, wherein the bracket push rod is welded by a steel plate and an angle iron.

9. The self-climbing robot for installing an elevator guide rail according to claim 1, wherein the driving motor is a servo motor.

* * * * *